US006085864A

United States Patent [19]

Copeland et al.

[11] Patent Number: 6,085,864

[45] Date of Patent: Jul. 11, 2000

[54] COUGH MUFFLER

[76] Inventors: Derrick Copeland, 115 Cherry Rd., Madison, Ala. 35758; Glen Copeland, 13338 Market St., Moulton, Ala. 35650; Lucian Copeland, 4854 Brashiers Chapel Rd., Arab, Ala. 35016

[21] Appl. No.: 09/397,816

[22] Filed: Sep. 17, 1999

[51] Int. Cl.[7] ..... G10K 11/12

[52] U.S. Cl. ..... 181/242; 180/21

[58] Field of Search ..... 181/242, 21, 252, 181/256, 258

[56] References Cited

U.S. PATENT DOCUMENTS

| | | | |
|---|---|---|---|
| 2,390,488 | 12/1945 | Alford et al. | 181/242 |
| 2,572,547 | 10/1951 | Webb | 181/242 |
| 2,625,615 | 1/1953 | Webb | 181/242 |
| 2,745,911 | 5/1956 | Webb | 181/242 |
| 4,396,089 | 8/1983 | Scully | 181/242 |
| 4,792,013 | 12/1988 | Boynton | 181/242 |
| 4,834,212 | 5/1989 | Figone et al. | 181/242 |
| 4,932,495 | 6/1990 | Chapman | 181/242 |
| 5,413,094 | 5/1995 | McBrearty | 181/242 |

*Primary Examiner*—Khanh Dang
*Attorney, Agent, or Firm*—Waddey& Patterson; John C. Garvin, Jr.

[57] ABSTRACT

A cough muffler for muffling the vocal sounds of a human. The muffler is especially designed for deadening or silencing vocal sounds, particularly coughing, of hunters and the like to avoid possible frightening away of the game being hunted. The cough muffler generally comprises four components, namely: a mouthpiece, a cup-shaped casing which defines a cavity, a first absorbent material, and a second absorbent material.

11 Claims, 4 Drawing Sheets

COUGH MUFFLER

FIELD OF THE INVENTION

The present invention relates to a device for effectively muffling vocal sounds, particularly coughing, with a particular utility in deadening such coughing sounds involuntarily made by hunters and the like, wherein the game being hunted may be easily frightened away by such coughing noise.

BACKGROUND OF THE INVENTION

There are several prior art devices for muffling vocal sounds, particularly coughing, sneezing, talking, singing, and even shouting. The following U.S. patents reflect the state of the art of which the applicants are aware insofar as they are somewhat germane and pertinent to their invention: U.S. Pat. Nos. 2,572,547 to Webb; 2,625,615 to Webb; 2,745,911 to Webb; 4,396,089 to Scully; 4,792,013 to Boynton; 4,834,212 to Figone et al.; 4,932,495 to Chapman; and 5,413,094 to McBrearty. Each of the three Webb patents discloses devices or masks for use in court reporting, assemblies, or other gatherings to receive directly the uttered or other sounds in such a manner as to be non-disturbing to adjacent or surrounding participants, spectators, or other persons, each of which incorporates an absorbing mass. In use, the devices disclosed by each of the Webb patents is held by one hand of the user and pressed against the user's face to surround the chin, mouth, and nose of the user. The Scully patent discloses a sound muffling cup into which an enraged person can shout to release tension while at the same time avoiding disturbing other persons. In use, the device disclosed by Scully is held by one hand of the user and pressed against the user's face to completely surround the mouth of the user. The Boynton patent discloses a globe-like device with a valve mechanism and internal baffles for muffling the cries of a baby. In use, the device disclosed by Boynton is placed over an infant's mouth and held in place by an attending person. The patent to Figone et al. discloses a human sound muffler and indicator to be held by a person for placement around that person's mouth and which includes a microphone and an associated electric circuit for receiving unabsorbed sound and providing an indication of the intensity of the unabsorbed sound which provides feedback to the user. The patent to Chapman discloses a device for muffling vocal sounds, particularly coughing or sneezing sounds, and has particular utility for deadening such sounds involuntarily made by hunters and the like, wherein the game being hunted is easily frightened away by such noises, and which also accommodates fluid flow volume. In use, the device disclosed by Chapman covers both the nose and mouth of the user. The patent to McBrearty discloses a device which is held in one hand and fits over a user's mouth and nose and which incorporates a core made of a noise reducing material for reducing the noise of coughs and sneezes.

These prior art devices suffer from numerous deficiencies and disadvantages. The present invention overcomes these deficiencies and disadvantages in that it provides an improved device that fills the need for a simple, inexpensive, cough or muffler that can be easily assembled and disassembled for cleaning and maintenance purposes.

SUMMARY OF THE INVENTION

In accordance with the present invention, a cough muffler is provided for deadening coughing and other vocal sounds. The cough muffler of the present invention is particularly useful to muffle coughs involuntarily made by hunters and the like, wherein the game being hunted may be easily frightened away by such coughing noise. The muffler of the present invention is also useful by bird watchers to deaden coughs which might otherwise frighten away the birds being watched.

The cough muffler of the present invention generally comprises a cup-shaped casing, a mouthpiece which extends into and out of the cup-shaped casing, and two pieces of absorbent material. The cough muffler can be easily disassembled, cleaned, and maintained in a conventional manner. The cough muffler of the present invention overcomes the known deficiencies and disadvantages of other types of devices designed to reduce sounds, particularly involuntary coughing sounds.

Accordingly, it is an object of the present invention to provide a simple inexpensive device for muffling or deadening vocal sounds such as coughs.

It is a further object of the present invention to provide a simple inexpensive device for muffling sounds such as coughs made by hunters, birdwatchers, and the like which might frighten away animals.

It is still a further object of the present invention to provide a device of simple construction for muffling or deadening involuntary coughs of outdoor persons to prevent the frightening away of animals.

These objects as well as other objects of the present invention will become more readily apparent from the following description in conjunction with the accompanying drawings.

DESCRIPTION OF THE PREFERRED EMBODIMENTS

Figure 1:
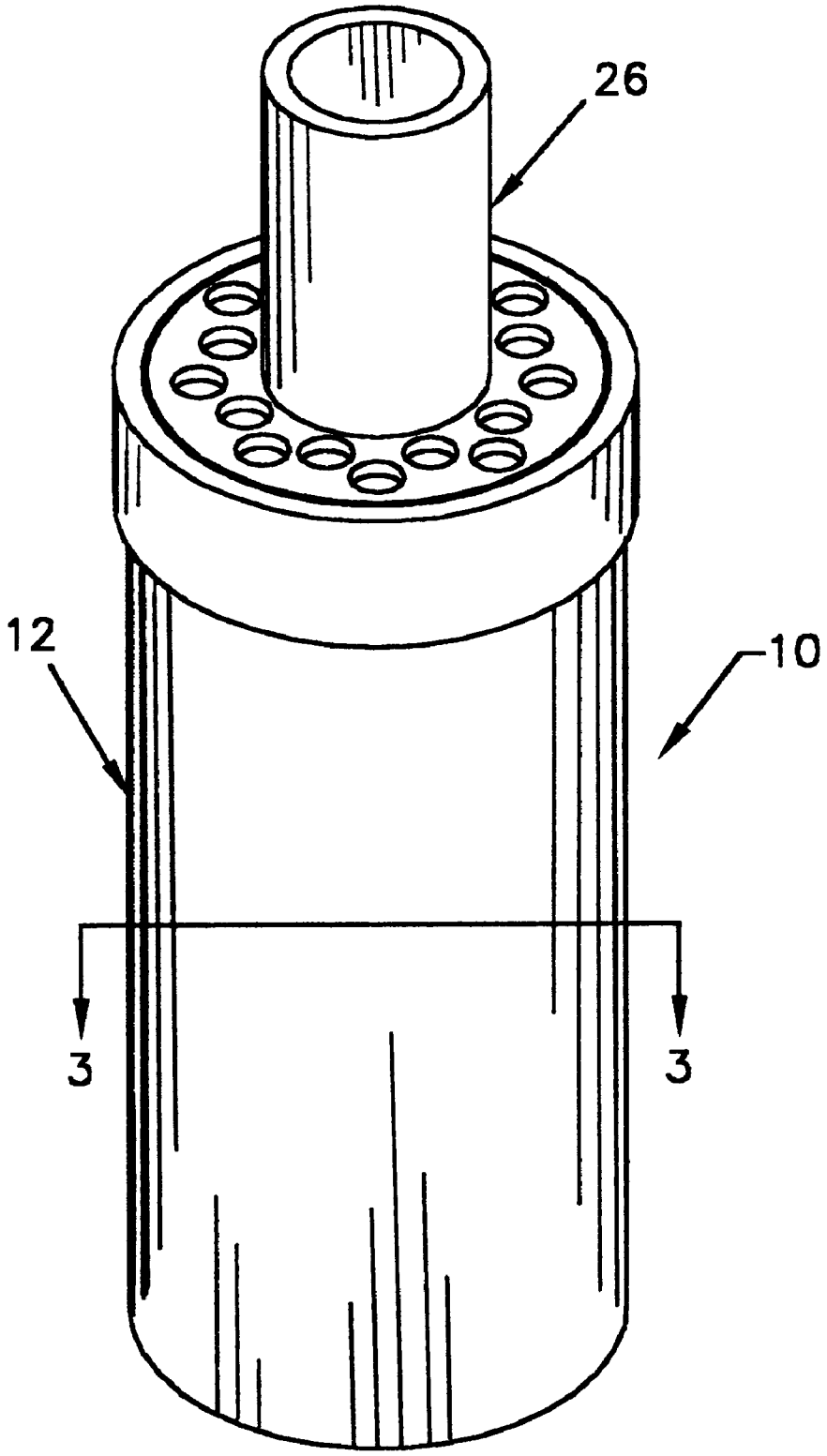
FIG. 1 is a top perspective view of the cough muffler of the present invention.
Figure 2:
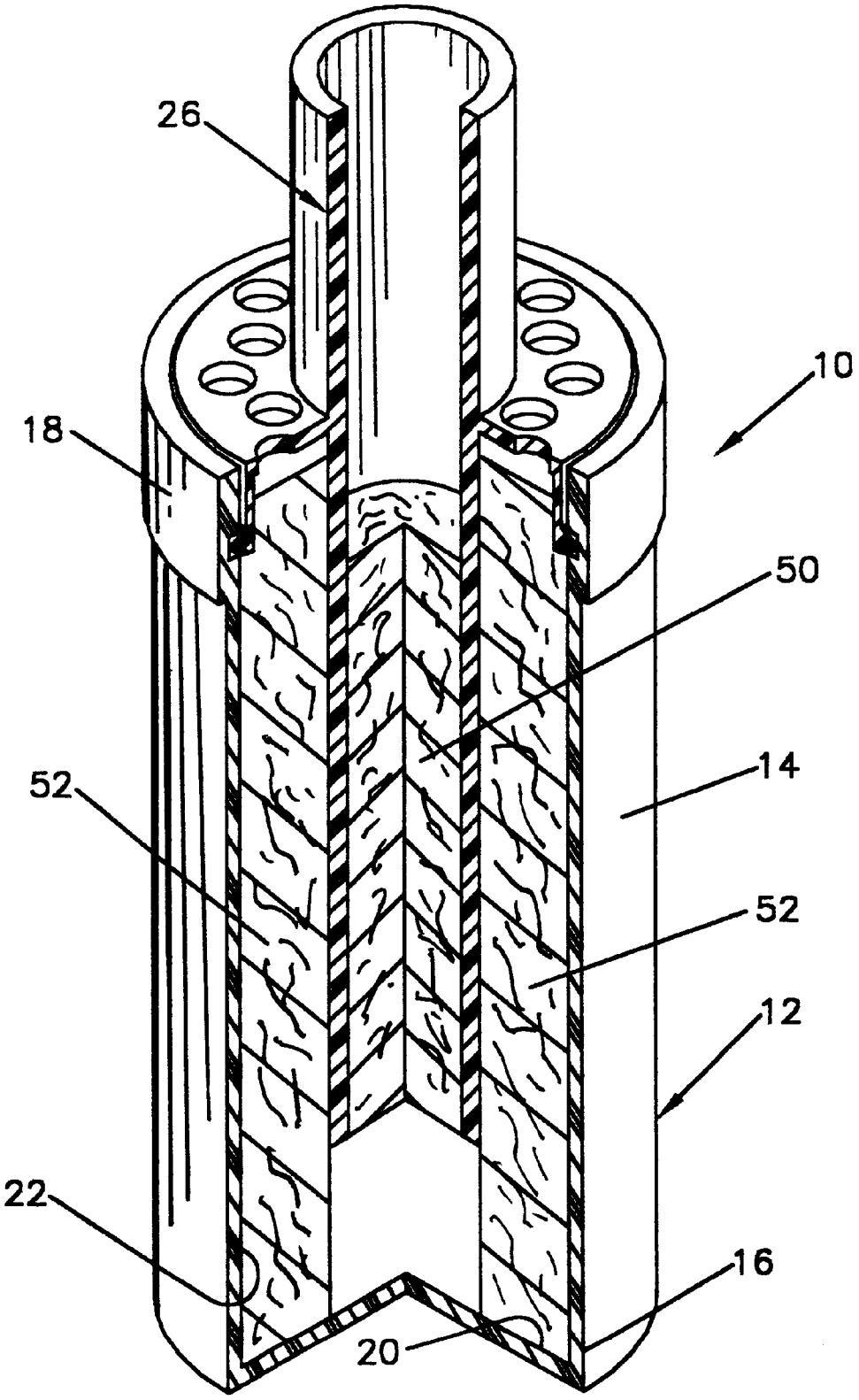
FIG. 2 is a cross-sectional view of the cough muffler of the present invention.
Figure 3:
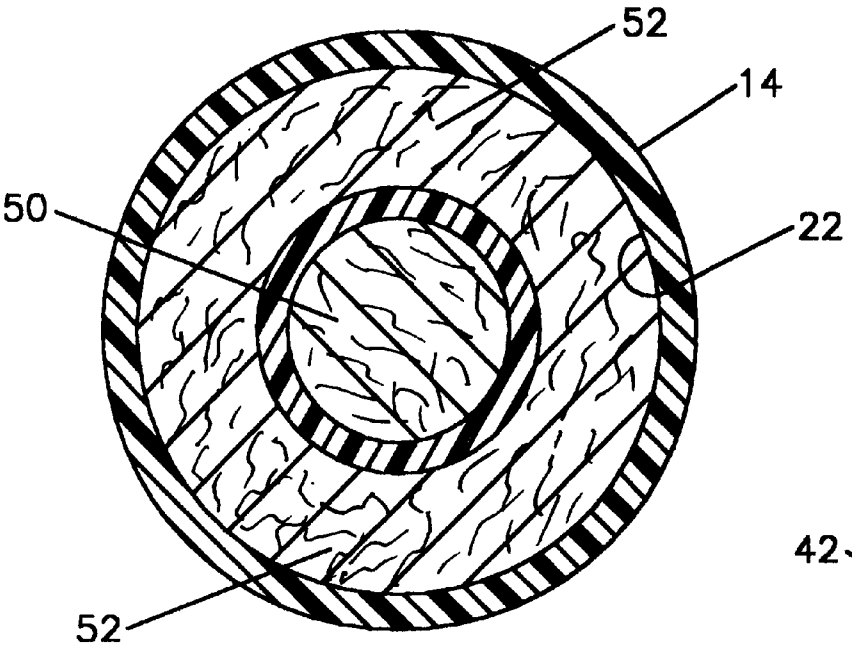
FIG. 3 is a cross-sectional view of the cough muffler of the present invention taken along line 3—3 of FIG. 1.

Referring now to the drawings, wherein like numerals represent like parts, reference numeral 10 generally designates the cough muffler of the present invention. As best seen in FIGS. 2 and 3, cough muffler 10 generally comprises a cup-shaped casing 12, a mouthpiece 26, a first piece of absorbent material 50, and a second piece of absorbent material 52.

Figure 4:
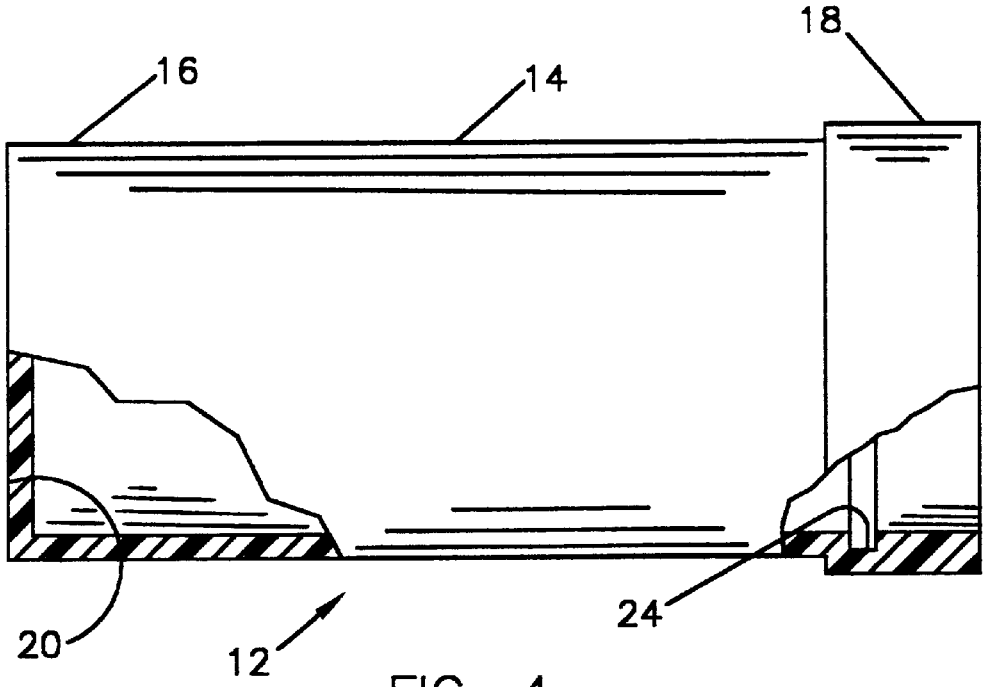
FIG. 4 is a side elevational, partially broken-away, view of the cup-shaped casing of the cough muffler of the present invention.

As best seen in FIGS. 2 and 4, cup-shaped casing 12 comprises an outer side wall 14 having a closed first end 16 and an opened enlarged second end 18, a closed bottom wall 20, a cavity 22, and an annular internal groove 24 within cavity 22 adjacent the enlarged second end 18 of outer side wall 14.

Figure 5:
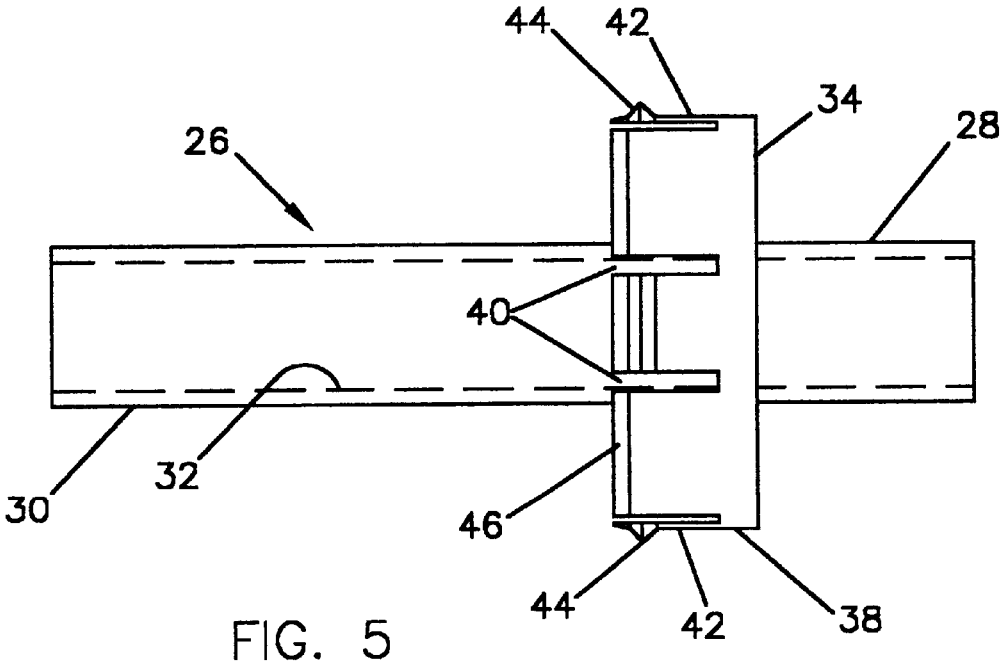
FIG. 5 is a side elevational view of the mouthpiece of the cough muffler of the present invention.

As best seen in FIGS. 2 and 5, mouthpiece 26 comprises a hollow outer end 28, a hollow inner end 30 which defines an inner cavity 32, an enlarged cover 34 adjacent the hollow inner end 28, a first piece of absorbent material 50 and a second piece of absorbent material 52.

Figure 6:
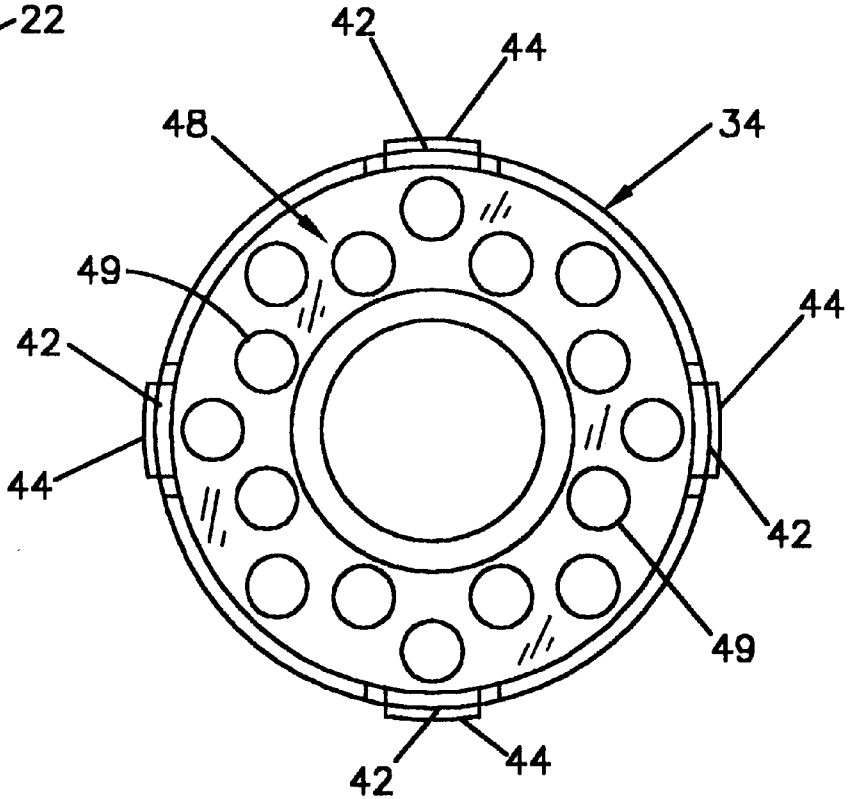
FIG. 6 is a top plan view of the mouthpiece of the cough muffler of the present invention.

As best seen in FIGS. 5 and 6, cover 34 of mouthpiece 26 comprises a circular sleeve 38 connected by a connector member 48 (FIG. 6) secured to each of the mouthpiece 26 and the circular sleeve 38. As best seen in FIG. 5, circular sleeve 38 has a plurality of pairs of slits 40 cut therein to form an equal number of flexible tabs 42, each of which has a locking projection 44 extending therefrom and a beveled surface 46. As best seen in FIG. 6, connector member 48 has two sets of numerous openings 49 therein for purposes to be explained later.

As best seen in FIGS. 2 and 3, the first piece of absorbent material 50 is placed within the inner cavity 32 of mouthpiece 26 such that it extends within cavity 32 from approximately the location of the connector member 40 to the inner end 30 of mouthpiece 26. As further best seen in FIGS. 2 and 3, the second pieces of absorbent material 52 is wrapped around the mouthpiece 26 from approximately the location of connector member 40 to the closed bottom wall 20 of cup-shaped casing 12.

It has been found that the Poly-fil Bumper Batting, Item No. PBB-10, a 100% bonded polyester, manufactured and sold by Fairfield Processing, 88 Rose Tail Avenue, Danbury, Conn. 06813 is a suitable absorbent material for incorporation in the cough muffler of the present invention. The casing 10 and mouthpiece 26 can be made of any suitable material such as 6—6 nylon which has a dull non-glossy appearance.

The cough muffler 10 can be best assembled by first stuffing the first absorbent material 50 within the inner cavity 32 of mouthpiece 26; then wrapping second absorbent material 52 around that portion of mouthpiece 26 between the location of the connector member 40 and beyond hollow inner end 30; and then moving or inserting the inner end 30 of the mouthpiece 26 into the cavity 22 of cup-shaped casing 12 until such time that the circular sleeve 38 enters the cavity 22 of cup-shaped casing 12 and the locking projections 44 of circular sleeve 38 snap into annular groove 24 within cavity 22 of cup-shaped casing 12. After the flexible locking projections 44 snap into the annular groove 24, cough muffler 24 is fully assembled and ready for use.

In use when a person senses that he must cough, he merely places his lip around the hollow outer end 28 (FIG. 5) of mouthpiece 26 and coughs freely through inner cavity 32 of mouthpiece 26. The absorbent material 50 and 52 absorbs or muffles the coughing noise and the openings 49 in connector member 48 allow enough air to reverse flow from the cough muffler 10 to satisfy the desire to cough and diminish the sound sufficiently so as to prevent the cough from alarming the game being hunted or the birds being watched.

The absorbent material 50 and 52 which filters the sound, together with the remainder of the cough muffling device 10, may be easily cleaned after use with a mild soap and water. The filter (absorbent material 50 and 52) may be placed back into muffling device 10 after it dries and the muffling device 10 reassembled. A user might replace the absorbent material 50 and 52 after four to eight weeks of continuous use.

Thus, although there have been described particular embodiments of the present invention of a new and useful Cough Muffler, it is not intended that such references be construed as limitations upon the scope of this invention except as set forth in the following claims.

What is claimed is:

1. A sound muffling device comprising:

a cup-shaped casing including a side wall having a closed first end, an opened second end, and a cavity therein;

a hollow mouthpiece including an outer end, an inner end, a cavity extending from said outer end to said inner end, an enlarged cover located adjacent said outer end between said outer end and said inner end and having a connecting member with a plurality of openings therein;

first absorbent means located within said cavity within said mouthpiece;

second absorbent means wrapped around a portion of said mouthpiece for insertion within and for substantially filling said cavity of said cup-shaped casing; and means for releasably securing said mouthpiece to said cup-shaped casing.

2. The sound muffling device of claim 1 wherein said first and second absorbent means is made of a polyester fibrous material.

3. The sound muffling device of claim 2 further including an internal annular groove within said cavity of said cup-shaped casing adjacent said second end of said cup-shaped casing.

4. The sound muffling device of claim 3 wherein said cover of said mouthpiece further includes a circular sleeve secured to said connecting member, said sleeve having a plurality of sets of slits therein for forming flexible tabs, each having a locking projection extending therefrom.

5. The sound muffling device of claim 4 wherein said internal annular groove and said locking projections constitute said means for releasably securing said mouthpiece to said cup-shaped casing.

6. The sound muffling device of claim 5 wherein said openings in said connecting member allow the reverse flow of air.

7. A sound muffling device comprising:

a hollow first member including a side wall having a closed first end, an enlarged, opened, second end, and a cavity therein;

a hollow second member including a tubular element having an outer end, an inner end, a cavity extending from said outer end to said inner end, a sleeve positioned between said outer end and said inner end, and means for connecting said sleeve to said tubular element;

first absorbent means positioned within said cavity in said tubular element;

second absorbent means positioned around a portion of said tubular element and adapted for insertion within and substantially filling said cavity of said hollow second member; and means for releasably securing said hollow second member to said hollow first member.

8. The sound muffling device of claim 7 wherein said first absorbent means is made of polyester fibrous material.

9. The sound muffling device of claim 7 wherein said means for releasably securing said hollow second member to said hollow first member includes an inner annular groove within said enlarged, opened, second end of said first hollow first member.

10. The sound muffling device of claim 9 wherein said means for releasably securing said hollow second member to said hollow first member includes at least one resilient tab having an outwardly extending projection thereon for engaging the walls of said inner annular groove within said enlarged, opened, end of said first hollow member.

11. The sound muffling device of claim 10 wherein said means for connecting said sleeve of said hollow second member to said tubular element of said second hollow second member has a plurality of openings therein for allowing the reverse flow of air.

* * * * *